United States Patent [19]

Mayama et al.

[11] 4,069,053

[45] Jan. 17, 1978

[54] PHOTOGRAPHIC FILMS

[75] Inventors: Masayoshi Mayama, Hachioji; Tohru Kobayashi, Tachikawa; Masahide Tamura, Hachioji, all of Japan

[73] Assignee: Konishiroku Photo Industry Co., Ltd., Tokyo, Japan

[21] Appl. No.: 783,443

[22] Filed: Mar. 31, 1977

Related U.S. Application Data

[63] Continuation of Ser. No. 547,884, Feb. 6, 1975, abandoned, which is a continuation-in-part of Ser. No. 444,663, Feb. 21, 1974, abandoned, which is a continuation of Ser. No. 232,193, March 6, 1972, abandoned.

[30] Foreign Application Priority Data

Mar. 18, 1971 Japan ..... 46-14727

[51] Int. Cl.$^2$ ..... G03C 1/98; G03C 1/02

[52] U.S. Cl. ..... 96/87 A; 96/114.2

[58] Field of Search ..... 96/87 A, 114.2, 22, 96/61 R

[56] References Cited

U.S. PATENT DOCUMENTS

| | | | |
|---|---|---|---|
| 2,801,191 | 7/1952 | Nadeau et al. | 96/84 |
| 3,053,662 | 9/1962 | Mackey et al. | 96/87 A |
| 3,159,487 | 12/1964 | Kreiger et al. | 96/75 |
| 3,514,291 | 5/1970 | Vanpoecke et al. | 96/87 A |
| 3,525,621 | 8/1970 | Miller | 96/87 A |
| 3,630,740 | 12/1971 | Victor et al. | 96/87 A |
| 3,635,714 | 1/1972 | Oshibuchi et al. | 96/87 A |
| 3,656,950 | 4/1972 | Bent et al. | 96/22 |
| 3,658,573 | 4/1972 | Guestaux et al. | 96/87 A |
| 3,775,124 | 11/1973 | Shirasu et al. | 96/61 R |

*Primary Examiner*—David Klein
*Assistant Examiner*—Louis Falasco
*Attorney, Agent, or Firm*—Haseltine, Lake & Waters

[57] ABSTRACT

A photographic film comprising a plastic support having first and second layers therein in that order, the first layer comprising a cellulose acetate together with a matting agent composed mainly of silicon dioxide of less than 1 $\mu$ in particle size, the second layer comprising a phosphoric acid ester, or an amine salt thereof of a $C_8$ to $C_{22}$-higher alkyl alcohol. A light-sensitive emulsion layer is carried on the other side of the support.

9 Claims, No Drawings

PHOTOGRAPHIC FILMS

CROSS-RELATED APPLICATION

This application is a continuation of Ser. No. 547,884 filed Feb. 6, 1975, now abandoned which is a continuation-in-part of Ser. No. 444,663 filed Feb. 21, 1974 which in turn is a continuation of Ser. No. 232,193 filed Mar. 6, 1972, all now abandoned.

FIELD OF THE INVENTION

This invention relates to light-sensitive photographic films, which are excellent in antistatic effect, which have surfaces free from "scratch" formation and which are stain resistant to developer solutions containing an organic solvent.

PRIOR ART

As is well known, cellulose acetate, polyethylene terephthalate and like plastic films, which are used as supports for photographic films, are easily charged with static electricity due to friction or peeling. Accordingly, photographic films using plastic films have had the drawback that they tend to be greatly charged with static electricity due to friction or peeling during their preparation or handling and consequently attract dust onto the film surface. In extreme cases, the light-sensitive layers are adversely affected due to discharge of the static electricity which form so-called static marks, and images obtained by using the photographic films show traces of the dust and static marks which reduces the quality of the film.

In order to overcome the above-mentioned drawbacks, various processes have heretofore been attempted. For example, there have been proposed a process in which the surfaces of plastic films are coated with a cationic, anionic, amphoteric or nonionic antistatic agent, either alone or in combination with a binder material excellent in film-forming property; a process in which plastics are incorporated with the antistatic agent as mentioned above and are shaped into films; and a process in which the surfaces of plastic films are coated with a silicon dioxide type material, either alone or in combination with a binder material excellent in film-forming property.

However, in the process in which plastics are incorporated with the antistatic agent and are shaped into films, this has the drawback that the antistatic agent tends to adversely affect the physical properties of the resulting films or oozes out of the films. The process in which the antistatic agent is coated on the surfaces of plastic films has the drawbacks that the surfaces become sticky or are freed from antistatic effects by waterwashing and, in the case where the antistatic agent is used in combination with any other material (e.g. binder), there are many restrictions in respect of compatibility, adhesiveness and the like. The process in which the silicon oxide type material is coated on the surfaces of plastic films is favorable in that the films show durable antistatic effects, but it has the drawback that the film surfaces tend to form scratches due to friction at various times. That is, during the preparation step, the films tend to form scratches due to contact or friction with coating or guide rolls and the like, while, during the handling and processing steps this tendency is observed due to friction occurring inside cameras, processing means and printers.

Furthermore, in the case where a material which has a film-forming property and which does not dissolve during development is used, the resulting photographic film sometime suffers from the formation of scratches there on during processing with a developing solution containing an organic solvent such as benzyl alcohol.

SUMMARY OF THE INVENTION

As a result of extensive studies, we have found that a photographic film, which has been prepared by successively forming on the back side of the support of a photographic film, a first layer comprising a cellulose acetate containing a matting agent composed mainly of silicon dioxide and, on said first layer, a second layer comprising a phosphoric acid ester, or an amine salt thereof, of a higher alcohol, is markedly excellent in antistatic effect and is free from scratch formation. It has also been found that even when the film is processed with a developing solution containing an organic solvent, the formation of scratches hardly occurs.

The matting agent used in the present invention may be composed of silicon dioxide alone or in combination with up to 25% of aluminum oxide, magnesium oxide or like oxide. Such oxide materials as above may be those which have been surfacially modified with an alkyl halide, e.g. methyl chloride, but they should be less than $1\mu$ in particle size. The cellulose acetate used in the present invention is preferably soluble in acetone. Ordinarily, cellulose diacetate having an acetylation degree of 54 to 56% is preferable, though this is not limitative. The amount of the cellulose acetate used is preferably 10 to 500 mg/m$^2$, while the matting agent, composed mainly of silicon dioxide, is preferably 1/10 to 2 times the amount of the cellulose acetate.

The phosphoric acid ester of higher alcohol which is used in the present invention is a phosphoric acid ester of a higher alcohol having 8 to 22, preferably 12 to 18, carbon atoms, and is used either as is or in the form of an amine salt. The phosphoric acid esters are preferably monolauryl, dilauryl, trilauryl, monohexadecyl, dihexadecyl, trihexadecyl, monooctadecyl, dioctadecyl, trioctadecyl, monobutylphenyl, dibutylphenyl, monononylphenyl and dinonylphenyl phosphoric acid esters. These are used as is or in the form of amine salts such as triethanolamine, diethanolamine, monoethanolamine, triethylamine, diethylamine and monoethylamine salts, and they may be used either alone or in the form of a mixture of two or more salts. The amount of the phosphoric acid ester used is preferably 6 to 20 mg/m$^2$, though this is not limitative.

In order to form, on a plastic film, the first layer comprising a cellulose acetate with a matting agent composed mainly of silicon dioxide, or the second layer comprising a phosphoric acid ester, or an amine salt thereof, of a higher alcohol, there is adopted, for example, a process in which a liquid dispersion or solution is formed by adding the cellulose acetate and matting agent or the phosphoric acid ester or its amine salt in a suitable solvent, and the dispersion or solution is coated onto the surface of the plastic film by spray coating, dip coating or similar coating procedure, followed by drying. In forming the first and/or second layers, there may be used, if necessary, subbing materials, plasticizers, colorants, defoaming agents and like adjuvants.

On the other side of the thus prepared plastic film support having the aforesaid two layers on one side, a light-sensitive layer is formed according to conventional procedure, whereby the photographic film of the present invention can be obtained. The thus obtained photographic film is successfully prevented not only from having scratches due to friction with various mechanical parts but also from having static charges due to friction or peeling, and there is no fear of causing deterioration in photographic properties (e.g. decrease in speed, increase in fog, variation in gamma, etc.).

The present invention is illustrated in further detail below with reference to examples.

EXAMPLE 1

10 Grams of a cellulose diacetate having an acetylation degree of 55% and a viscosity of 40 seconds (as measured according to the method of ASTM; 20% concentration), which had been prepared according to a conventional method, was dissolved in a mixed solvent comprising 300 ml. of acetone, 600 ml. of ethyl acetate and 100 ml. of benzene. Into the resulting solution was dispersed 1.5 g. of Aerosil 200 (trademark for a product produced by Nippon Aerosil Co., Ltd., said product being silicon dioxide particles of 10 to 20 mμ in primary particle size and 100 mμ to 1 μ in secondary particle size;) to prepare a treating liquid (A). The treating liquid (A) was coated onto one side of a cellulose triacetate film in an amount of 40 ml/m² and then it was dried to obtain a cellulose triacetate film (1) having a first layer therein. Subsequently, 200 mg. of dilauryl phosphate triethanolamine salt was dissolved in a mixed solvent comprising 960 ml. of carbon tetrachloride and 40 ml. of ethylene chloride to prepare a treating liquid (B). This treating liquid (B) was coated onto the first layer of the film (1) in an amount of 20 ml/m² and then it was dried to form a second layer. Thus, a cellulose triacetate film (2) having the first and second layers was obtained.

The thus obtained film (2) was used as a support, and a sub layer was formed on the other side thereof. Thereafter, a light-sensitive emulsion was coated on said sub layer and then dried to produce a photographic film (a) of the present invention.

The photographic film (a) was subjected to a series of practical tests such as photographing with a camera, development, printing, etc. As a result, the image obtained from the photographic film (a) had substantially no static marks or traces of dust and the like, nor traces of scratches. Furthermore, no degradation in the photographic properties thereof was observed. On the other hand, a photographic film (b) using the film (1) as the support and a photographic film (c) using as the support the film having only the second layer were treated in the same manner as in the case of the aforesaid photographic film (a) of the present invention. As a result, considerable traces of scratches were observed in the images obtained from the photographic films (b) and (c).

The aforesaid photographic film (a) was subjected to development with an automatic color developing apparatus using a developer solution of a formulation as shown hereunder in Table 1, and no traces of scratches were observed on the back side of the film.

Table 1

| (Formulation of developer solution) | | |
|---|---|---|
| Water | 800 | ml |
| Benzyl alcohol | 3.8 | ml |
| Sodium hexamethaphosphate | 2.0 | g |
| Sodium sulfite (anhydrous) | 2.0 | g |
| Sodium carbonate (anhydrous) | 50.0 | g |
| Potassium bromide | 1.0 | g |
| Sodium hydroxide (10% aqueous solution) | 5.5 | ml |

Table 1-continued

| (Formulation of developer solution) | | |
|---|---|---|
| 4-Amino-3-methyl-N-ethyl-N-(methylsulfonamidoethyl)-aniline, 3/2 $H_2SO_4$ monohydrate | 5.0 | g |
| Ethylene glycol and water to make | 1 | liter |

EXAMPLE 2

2 Grams of the same cellulose diacetate as in Example 1 were dissolved in a mixed solvent comprising 700 ml. of acetone and 300 ml. of methanol. Into the resulting solution were dispersed 2 g. of the silicon dioxide particles used in Example 1 to prepare a treating liquid (C). The treating liquid (C) was coated on one side of a cellulose triacetate film in an amount of 20 ml/m² and then it was dried to obtain a cellulose triacetate film (3) having a first layer. Subsequently, 400 mg. of a 2:3 (by molar ratio) mixture of dihexadecyl phosphate triethylamine salt and monohexadecyl phosphate triethylamine salt were dissolved in a mixed solvent comprising 950 ml. of methanol and 50 ml. of acetone to prepare a treating liquid (D). This treating liquid (D) was coated on the first layer of the film (3) in a proportion of 20 ml/m² and then dried to form a second layer. In the above manner, a cellulose triacetate film (4) having the first and second layers was obtained.

The thus obtained film (4) was used as a support, and a sub layer was formed on the other side thereof. Thereafter, a light-sensitive emulsion was coated on said sub layer and then dried to prepare a photographic film (d) of the present invention. The photographic film (d) was subjected to a series of practical tests such as photography exposure, development, printing, etc. As a result, the image obtained from the photographic film (d) had substantially no static marks or traces of dust and the like, no traces of scratches, and no degradation in photographic properties thereof. On the other hand, a photographic film (e) using the film (3) as the support and a photographic film (f) using as the support the film having only the second layer were treated in the same manner as in the case of the aforesaid photographic film (d) of the present invention. As a result, considerable traces of scratches were observed in the images obtained from the photographic films (e) and (f).

EXAMPLE 3

500 Milligrams of a cellulose diacetate having an acetylation degree of 55% and a viscosity of 50 seconds (as measured according to the method of ASTM-E; 20% concentration), which had been prepared according to a conventional method, and 100 mg. of a 63:35:2 (by weight ratio) ternary copolymer of vinylidene chloride, methyl acrylate and acrylic acid were dissolved in a mixed solvent comprising 500 ml. of acetone, 400 ml. of ethylene dichloride and 100 ml. of phenol. Into the resulting solution was dispersed 800 mg. of Aerosil R-972 (trademark for a product produced by Nippon Aerosil Co., Ltd., said product being silicon dioxide particles of 10 to 20 mμ in primary particle size and 100 mμ to 1μ in secondary particle size which had been modified with methyl chloride to have a methyl group present on the surface of said particles) to prepare a treating liquid (E). The treating liquid (E) was coated on one side of a polyethylene terephthalate film in an amount of 20 ml/m² and then dried to obtain a polyethylene terephthalate film (5) having a first layer. Subsequently, 100 mg. of trioctadecyl phosphate were dissolved in a mixed solvent comprising 980 ml. of carbon tetrachloride and 20 ml. of phenol to prepare a treating liquid (F). This treating liquid (F) was coated on the first layer of the film (5) in a proportion of 20 ml/m² and then dried to form a second layer. In the above manner, a polyethylene terephthalate film (6) having the first and second layers were obtained.

The thus obtained film (6) was used as a support, and a sub layer was formed on the other side thereof. Thereafter, a light-sensitive emulsion was coated on said sub layer and then dried to prepare a photographic film (g) of the present invention.

The photographic film (g) was subjected to a series of practical tests such as photographic exposure, development, printing, etc. As a result, the image obtained from the photographic film (g) had substantially no static marks or traces of dust and the like nor traces of scratches, and no degradation in photographic properties was observed. On the other hand, a photographic film (h) using the film (5) as the support and a photographic film (i) using as the support the film having only the second layer were treated in the same manner as in the case of the aforesaid photographic film (g) of the present invention. As the result, considerable traces of scratches were observed in the images obtained from the photographic films (h) and (i).

COMPARISON EXAMPLES

Samples with their respective formulations as shown in Table 2 were prepared according to the process described in Examples 1 and 2 of U.S. Pat. No. 3,635,714 and those in Examples 1 and 2 of the present invention, respectively. Each sample film was subjected to practical tests as well as to scratch tests to obtain the results as shown in Table 3.

Table 2

| | | (Sample film) First layer | | | | | |
|---|---|---|---|---|---|---|---|
| Sample | | Resin | Concentration | Matting agent | Concentration | Solvent | Second layer |
| | a-1 (Ex. 1) | Polyvinyl acetal(I) | 100 g/l | Pearl polymerization of styrene | 0.05g/l | Same as in Ex. 1 | Same as in Ex. 1 |
| Reference A | b-1 (Ex. 2) | vinylek F | 40 | Silicon dioxide diam. 3 | in Ex. 2 | Same as in Ex. 2 | Same as |
| Present invention | (Ex. 1) | Cellulose acetate | 10 | Aerosil 200 | 1.5 | Same as in Ex. 1 | Same as in Ex. 1 |
| | (Ex. 2) | " | 2 | " | 2 | n Ex. 2 | in Ex. 2 |

Table 3

| | (Test results) | | | | |
|---|---|---|---|---|---|
| | Practical test (1) | | Scratch test (2) | | (3) |
| Sample | Static mark | Trace of scratch | 0.5 mil-needle | 20 mil-needle | Stain during development |
| a-1 | None | Slight | 7 g | 300 g | Large |
| b-1 | " | " | 7 | 300 | " |
| a | " | " | 2 | 1300 | None |
| b | " | " | 2 | 1300 | " |

Notes:
(1) The practical test was conducted according to the method described in the present specification.
(2) Each sample was scratched on the surface with a needle each having a point of 0.5 mil and 20 mil in diameter under progressively varying load. The scratched sample was printed on a printing paper by means of an enlarger to observe traces of scratches formed thereon. The scratch-resistance property was determined by the load in terms of weight in grams at which scratches began to be formed.
(3) Each sample was developed by means of a hanger type automatic color developing apparatus using a color developer solution of the following formulation to observe the degree of formation of stains on the back side of the film sample.

| Formulation of developer solution | | |
|---|---|---|
| Water | 800 | ml |
| Benzyl alcohol | 3.8 | ml |
| Sodium hexamethaphosphate | 2.0 | g |
| Sodium sulfite (anhydrous) | 2.0 | g |
| Sodium carbonate (anhydrous) | 50.0 | g |
| Potassium bromide | 1.0 | g |
| Sodium hydroxide (10% aqueous solution) | 5.5 | ml |
| 4-Amino-3-methyl-N-ethyl-N-(methylsulfonamidoethyl)-aniline, 3/2 $H_2SO_4$ monohydrate | 5.0 | g |
| Ethylene glycol and water to make | 1 | liter |

The film was hung over a hanger while the emulsion side on the depending lengths were directed outwardly. In such case, drops of the developer solution were retained both on the upper and lower portions of the film thus hung, and the drops retained on the said upper portion serve to form stains on the resulting image developed on the film.

It was found that the acetals used in U.S. Pat. No. 3,635,714 form stains during the developing process, whereas the films with the cellulose diacetate as used in the present invention is less liable to the formation of stains.

No particular scratch-preventing effect can be expected even when the acetals used in U.S. Pat. No. 3,635,714 are used in combination with a matting agent having a particle size of 1μ or larger. It is therefore deemed significant to use finely pulverized particles of the matting agent throughout the surface of film as in the present invention. When a matting agent having a larger particle size is present throughout the film surface, the film comes to lose its transparency when it is developed and it is found generally unsuitable for photographic purposes.

What is claimed is:

1. In a photographic film having a plastic support; a first layer comprising cellulose acetate and a matting agent comprising silicon dioxide less than 1μ in particle size; a second layer comprising a phosphoric acid ester of a $C_8$ to $C_{22}$-higher alkyl alcohol, or an amine salt thereof, said first and second layers being carried in that order on one side of the support; and a light-sensitive emulsion layer on the other side of the support.

2. A photographic film as claimed in claim 1, wherein said matting agent further comprises up to 25% of at least one of aluminum oxide and magnesium oxide.

3. A photographic film as claimed in claim 2, wherein said silicon dioxide is modified by treatment with methyl chloride.

4. A photographic film as claimed in claim 1, wherein said first layer further comprises at least one of a plasticizer, a colorant or a defoaming agent.

5. A photographic film as claimed in claim 1, wherein said second layer further comprises at least one of a plasticizer, a colorant or a defoaming agent.

6. A photographic film as claimed in claim 1, wherein said emulsion layer is a light-sensitive gelatino-silver halide photographic emulsion layer and is coated on a sub layer applied to the other side of the support.

7. A photographic film as claimed in claim 1, wherein the plastic support is a film of cellulose triacetate or polyethylene terephthalate.

8. A photographic film which is stain-resistant to developing solutions containing an organic solvent, said film comprising a plastic support of cellulose triacetate or polyethylene terephthalate; a first layer comprising cellulose acetate in an amount of 10–500 mg. per square meter of the layer, and a matting agent of silicon dioxide less than 1$\mu$ in particle size in an amount of 0.1 to 0.5 part per part of cellulose acetate; a second layer comprising a phosphoric acid ester of a $C_8$ to $C_{22}$-higher alkyl alcohol, or an amine salt thereof, in an amount of 6–20 mg. per square meter of said second layer, said first and second layers being carried in that order on one side of said support; and a light-sensitive gelatino-silver halide photographic emulsion layer on the other side of said support.

9. A method of producing a photographic film which is stain-resistant to developing solutions containing an organic solvent, said method comprising forming a plastic support of cellulose triacetate or polyethylene terephthalate, depositing a first layer on one side of the support, said first layer comprising cellulose acetate in an amount of 10–500 mg. per square meter of the layer, and a matting agent of silicon dioxide less than 1$\mu$ in particle size in an amount of 0.1 to 0.5 part per part of cellulose acetate, depositing a second layer on the first layer, said second layer comprising a phosphoric acid ester of a $C_8$ to $C_{22}$-higher alkyl alcohol, or an amine salt thereof, in an amount of 6–20 mg. per square meter of said second layer, and depositing a light-sensitive gelatino-silver halide photographic emulsion layer on the other side of said support.

* * * * *